US009894986B2

(12) United States Patent
Tegeder et al.

(10) Patent No.: US 9,894,986 B2
(45) Date of Patent: Feb. 20, 2018

(54) TODDLER TOOTHBRUSH ASSEMBLY AND METHODS

(71) Applicant: Live-Right, LLC, Pocatello, ID (US)

(72) Inventors: Troy Tegeder, Winchester, CA (US); Chad Winward, Shelley, ID (US); Natalee Dawn Phillips, San Diego, CA (US); Sandra Lee Phillips, Pocatello, ID (US); Charles Reeve Phillips, Burbank, CA (US)

(73) Assignee: Live-Right, LLC, Idaho Falls, ID (US)

( * ) Notice: Subject to any disclaimer, the term of this patent is extended or adjusted under 35 U.S.C. 154(b) by 388 days.

(21) Appl. No.: 14/802,831

(22) Filed: Jul. 17, 2015

(65) Prior Publication Data

US 2017/0013953 A1 Jan. 19, 2017

(51) Int. Cl.
*A46B 5/02* (2006.01)
*A46B 9/04* (2006.01)
(Continued)

(52) U.S. Cl.
CPC ..... *A46B 15/0089* (2013.01); *A46B 5/021* (2013.01); *A46B 5/023* (2013.01);
(Continued)

(58) Field of Classification Search
CPC ..... A46B 5/021; A46B 5/023; A46B 9/04; A46B 15/0089; A46B 2200/1066
See application file for complete search history.

(56) References Cited

U.S. PATENT DOCUMENTS 5,353,464 A * 10/1994 Atkins ..... A46B 5/00 15/143.1
6,345,406 B1 2/2002 Dodd
(Continued)

FOREIGN PATENT DOCUMENTS

CN 2041516 U 7/1989
CN 1159744 A 9/1997
(Continued)

OTHER PUBLICATIONS

Dreambaby Three Stage Toothbrush Set, Amazon.com, www.amazon.com/Dreambaby-Three-Stage-Toothbrush-Pink/dp/B00DBEH6RC, as early as May 5, 2015.
(Continued)

*Primary Examiner* — Randall Chin
(74) *Attorney, Agent, or Firm* — Kirton McConkie; Brian Tucker

(57) ABSTRACT

Toothbrush assemblies have a structural component and a cushioning component disposed about a portion of the structural component. The structural component has a distal head element, an elongated spacing element extending from the head element, and a body portion connected to the spacing element opposite the head element. The cushioning component causes the structural component to resist movement in the posterior direction to a larger degree than the structural component resists movement in the anterior direction. Accordingly, an axial force applied to the head element in the direction of the spacing element causes the spacing element to move in the anterior direction. Thus, the toothbrush assembly can be safe for toddlers to use as they can be less likely to impale the toddler's throat tissue and/or puncture a vital artery.

12 Claims, 7 Drawing Sheets

(51) Int. Cl.
*A46B 15/00* (2006.01)
*A46D 3/00* (2006.01)

(52) U.S. Cl.
CPC ..... *A46B 9/04* (2013.01); *A46D 3/00* (2013.01); *A46B 2200/1066* (2013.01)

(56) References Cited

U.S. PATENT DOCUMENTS

| | | | | |
|---|---|---|---|---|
| 6,461,164 | B1 * | 10/2002 | Ramelli | A46B 5/00 15/167.1 |
| 7,039,984 | B1 | 5/2006 | Watanabe et al. | |
| 2005/0147458 | A1 | 7/2005 | Hohlbein | |
| 2006/0016033 | A1 | 1/2006 | Carpenter | |
| 2010/0132731 | A1 * | 6/2010 | Waitesmith | A45D 40/262 132/200 |
| 2016/0073769 | A1 * | 3/2016 | Xi | A46B 5/026 15/143.1 |

FOREIGN PATENT DOCUMENTS

| | | |
|---|---|---|
| DE | 203 06 937 U1 | 9/2003 |
| KR | 10-1239639 | 3/2013 |
| WO | 2007/034291 A1 | 3/2007 |

OTHER PUBLICATIONS

Baby Banana Bendable Training Toothbrush Infant, Amazon.com, www.amazon.com/Baby-Banana-Bendable-Training-Toothbrush/dp/B002QYW8L . . . , as early as May 5, 2015.

Kids Toothbrush, Model #KBE-B304700, http://best-b2b.com/Products/764/769-2/kids-toothbrush_304700.html, as early as May 5, 2015.

Kay Products Easy-Grip Toothbrushes, http://kayeproducts.com/easy-grip-toothbrushes/, as early as May 5, 2015.

Dinosaur Shaped Handle with Rubber Suction Cub Kids ' Toobrush, Model No. X011, http://sell.lulusoso.com/selling-leads/3500921/-X011-dinosaur-shaped-handle-with-rubber- . . . , as early as May 5, 2015.

* cited by examiner

TODDLER TOOTHBRUSH ASSEMBLY AND METHODS

BACKGROUND

1. Technical Field

The present disclosure relates generally to toothbrushes. In particular, the present disclosure relates to toddler toothbrushes and methods of forming the same. The present disclosure further relates to a safety toothbrush configured to flex in an anterior direction and/or resist flexion in a posterior direction.

2. Related Technology

The common toothbrush is an oral cleaning device that has a bristled-head disposed at the end of an elongated handle. Toothbrushes, as well as bristles and handles thereof, are available in a variety of shapes, sizes, colors, and configurations. Some toothbrushes are sized, shaped, and otherwise configured for toddler use. For instance, toddler toothbrushes may have smaller, fewer, or softer bristles. Toddler toothbrushes may also have a smaller or shorter handle for use by toddlers.

Regardless of the specific type or configuration, existing toothbrushes are configured to resist flexion in the posterior direction—as the bristles are pressed against the teeth, gums, or tongue. Hence, toothbrushes can be effective in cleaning teeth and other oral structures. However, due to their structure and composition, existing toothbrushes also resist flexion in the anterior direction, as well as laterally. Indeed, some toothbrushes even include a soft, tongue scrubber disposed on the head of the toothbrush opposite the bristles. Because the toothbrush resists flexion in the anterior direction, the toothbrush can be turned over and the soft material can be used to scrub residue from the top of the tongue.

In the case of toddler toothbrushes, such anterior flex-resistance may be undesirable. For instance, a toddler learning to brush her teeth may inadvertently force the toothbrush past her teeth and contact the back of her mouth or throat with the head of the toothbrush. Similarly, toddlers have been known to run with a toothbrush in their mouth such that an accidental fall (forward) can cause the toothbrush to be forced into the toddler's mouth or throat. The rigid, anterior, posterior, and lateral flex-resistance of the toothbrush may prevent the toothbrush from bending sufficiently to avoid the toothbrush impaling the toddler's tissue and even puncturing a vital artery.

Accordingly, it would be beneficial to provide a toothbrush or toothbrush assembly that is biased to flex in the anterior direction when axial pressure is applied to the head of the toothbrush.

BRIEF DESCRIPTION OF THE DRAWINGS

In order to describe the manner in which the above-recited and other advantages and features of the invention can be obtained, or to further clarify the above and other advantages and features of the present disclosure, a more particular description of the disclosure briefly described above will be rendered by reference to specific implementations and/or embodiments thereof which are illustrated in the appended drawings. While the drawings are generally drawn to scale for some example embodiments, it should be understood that the scale may be varied and the illustrated embodiments are not necessarily drawn to scale for all embodiments encompassed herein.

Furthermore, it will be readily appreciated that the components of the illustrative embodiments, as generally described and illustrated in the figures herein, could be arranged and designed in a wide variety of different configurations, and that components within some figures are interchangeable with, or may supplement, features and components illustrated in other figures. Accordingly, understanding that the drawings depict only typical implementations and/or embodiments of the disclosure and are not, therefore, to be considered to be limiting of its scope, the embodiments will be described and explained with additional specificity and detail through the use of the accompanying drawings in which.

DETAILED DESCRIPTION

Figure 1A:
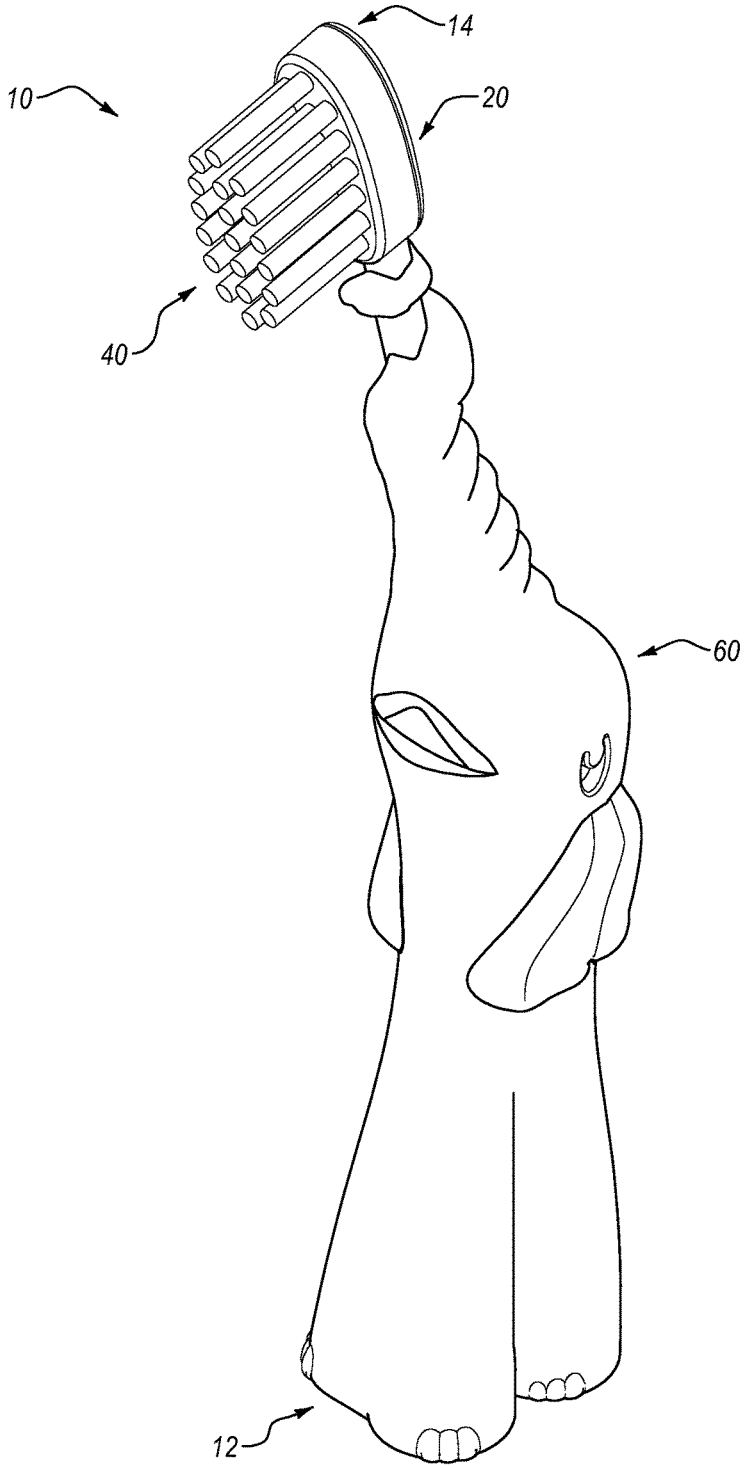
FIG. 1A illustrates a perspective view of a toothbrush assembly in accordance with an embodiment of the present disclosure.

Before describing the present disclosure in detail, it is to be understood that this disclosure is not limited to the specific parameters of the particularly exemplified systems, methods, apparatus, assemblies, products, processes, and/or kits, which may, of course, vary. It is also to be understood that much, if not all of the terminology used herein is only for the purpose of describing particular embodiments of the present disclosure, and is not necessarily intended to limit the scope of the disclosure in any particular manner. Thus, while the present disclosure will be described in detail with reference to specific configurations, embodiments, and/or implementations thereof, the descriptions are illustrative only and are not to be construed as limiting the scope of the claimed invention.

Various aspects of the present disclosure, including devices, systems, methods, etc., may be illustrated with reference to one or more exemplary embodiments or implementations. As used herein, the terms "exemplary embodiment" and/or "exemplary implementation" means "serving as an example, instance, or illustration," and should not necessarily be construed as preferred or advantageous over other embodiments or implementations disclosed herein. In addition, reference to an "implementation" of the present disclosure or invention includes a specific reference to one or more embodiments thereof, and vice versa, and is intended to provide illustrative examples without limiting the scope of the invention, which is indicated by the appended claims rather than by the following description.

Furthermore, unless defined otherwise, all technical and scientific terms used herein have the same meaning as commonly understood by one of ordinary skill in the art to which the present disclosure pertains. While a number of methods and materials similar or equivalent to those described herein can be used in the practice of the present disclosure, only certain exemplary materials and methods are described herein.

It will be noted that, as used in this specification and the appended claims, the singular forms "a," "an" and "the" include plural referents unless the content clearly dictates otherwise. Thus, for example, reference to a "column" includes one, two, or more columns. Similarly, reference to a plurality of referents should be interpreted as comprising a single referent and/or a plurality of referents unless the content and/or context clearly dictate otherwise. Thus, reference to " columns" does not necessarily require a plurality of such columns. Instead, it will be appreciated that independent of conjugation; one or more columns are contemplated herein.

As used throughout this application the words "can" and "may" are used in a permissive sense (i.e., meaning having the potential to), rather than the mandatory sense (i.e., meaning must). Additionally, the terms "including," "having," "involving," "containing," "characterized by," as well as variants thereof (e.g., "includes," "has," and "involves," "contains," etc.), and similar terms as used herein, including the claims, shall be inclusive and/or open-ended, shall have the same meaning as the word "comprising" and variants thereof (e.g., "comprise" and "comprises"), and do not exclude additional, un-recited elements or method steps, illustratively.

Various aspects of the present disclosure can be illustrated by describing components that are coupled, attached, connected, and/or joined together. As used herein, the terms "coupled", "attached", "connected," and/or "joined" are used to indicate either a direct association between two components or, where appropriate, an indirect association with one another through intervening or intermediate components. In contrast, when a component is referred to as being "directly coupled", "directly attached", "directly connected," and/or "directly joined" to another component, no intervening elements are present or contemplated. Thus, as used herein, the terms "connection," "connected," and the like do not necessarily imply direct contact between the two or more elements. In addition, components that are coupled, attached, connected, and/or joined together are not necessarily (reversibly or permanently) secured to one another. For instance, coupling, attaching, connecting, and/or joining can comprise placing, positioning, and/or disposing the components together or otherwise adjacent in some implementations.

As used herein, directional and/or arbitrary terms, such as "top," "bottom," "front," "back," "rear," "left," "right," "up," "down," "upper," "lower," "inner," "outer," "internal," "external," "interior," "exterior," "anterior," "posterior," "proximal," "distal," and the like can be used solely to indicate relative directions and/or orientations and may not otherwise be intended to limit the scope of the disclosure, including the specification, invention, and/or claims.

To facilitate understanding, like reference numerals have been used, where possible, to designate like elements common to the figures. Furthermore, alternative configurations of a particular element may each include separate letters appended to the element number. Accordingly, an appended letter can be used to designate an alternative design, structure, function, implementation, and/or embodiment of an element or feature without an appended letter. Similarly, multiple instances of an element and or sub-elements of a parent element may each include separate letters appended to the element number. In each case, the element label may be used without an appended letter to generally refer to instances of the element or any one of the alternative elements. Element labels including an appended letter can be used to refer to a specific instance of the element or to distinguish or draw attention to multiple uses of the element. However, element labels including an appended letter are not meant to be limited to the specific and/or particular embodiment(s) in which they are illustrated. In other words, reference to a specific feature in relation to one embodiment should not be construed as being limited to applications only within said embodiment.

It will also be appreciated that where two or more values, or a range of values (e.g., less than, greater than, at least, and/or up to a certain value, and/or between two recited values) is disclosed or recited, any specific value or range of values falling within the disclosed values or range of values is likewise disclosed and contemplated herein. Thus, disclosure of an illustrative measurement or distance less than or equal to about 10 units or between 0 and 10 units includes, illustratively, a specific disclosure of: (i) a measurement of 9 units, 5 units, 1 units, or any other value between 0 and 10 units, including 0 units and/or 10 units; and/or (ii) a measurement between 9 units and 1 units, between 8 units and 2 units, between 6 units and 4 units, and/or any other range of values between 0 and 10 units.

Various modifications can be made to the illustrated embodiments without departing from the spirit and scope of the invention as defined by the claims. Thus, while various aspects and embodiments have been disclosed herein, other aspects and embodiments are contemplated. It is also noted that systems, methods, apparatus, devices, products, processes, and/or kits, etc., according to certain embodiments of the present disclosure may include, incorporate, or otherwise comprise properties, features, components, members, and/or elements described in other embodiments disclosed and/or described herein. Thus, reference to a specific feature in relation to one embodiment should not be construed as being limited to applications only within said embodiment.

The headings used herein are for organizational purposes only and are not meant to be used to limit the scope of the description or the claims.

In the present disclosure, example methods, devices, and/or assemblies may be described with reference to one or more plastic materials (e.g., hard plastic and/or soft plastic). As used herein, the term "hard plastic" refers to polymeric substances that are substantially rigid to the touch and require a substantial exertion of force to flex or otherwise alter the structural configuration thereof. Such "hard plastic" polymeric substances can include material(s) formed from any one of the following thermoplastic polymers (including alloys, blends, and/or combinations thereof) and/or other suitable polymeric substances: polyethylene terephthalate (PET), polyethylene terephthalate with glycol-modification (PETG), acrylonitrile butadiene-styrene (ABS), polyvinyl chloride (PVC), polyvinyl butyral (PVB), ethylene vinyl acetate (EVA), polycarbonate (PC), styrene, polymethyl methacrylate (PMMA), polyolefins (low and high density polyethylene, polypropylene), thermoplastic polyurethane (TPU), cellulose-based polymers (cellulose acetate, cellulose butyrate or cellulose propionate).

As used herein, the term "soft plastic" refers to polymeric substances that are substantially flexible to the touch and require only a small exertion of force to flex or otherwise alter the structural configuration thereof. Such "soft plastic" polymeric substances can include material(s) formed from any one of the following classes of thermoplastic elastomers (TPE) (including alloys, blends, and/or combinations thereof) and/or other suitable polymeric substances: styrenic block copolymers (TPE-s); polyolefin blends (TPE-o); elastomeric alloys (TPE-v or TPV); thermoplastic polyurethanes (TPU); thermoplastic copolyester; and thermoplastic polyamides.

While the present disclosure refers specifically to toothbrushes and toddler toothbrushes, it is noted that the disclosure is not limited to a human toothbrush. Certain embodiments can be used for veterinary or other purposes without departing from the scope of this disclosure. In addition, the particular features, configurations, design characteristics, and/or component (assemblies) described herein can be applicable to a variety of different fields of use. For instance, a device having an inner structural component and an outer cushioning component disposed about at least a portion of the structural component such that (i) the cushioning component inhibits movement (e.g., via pivot or flexion) of the structural component in a posterior direction to a larger degree than the cushioning component inhibits movement (e.g., via pivot or flexion) of the structural component in an anterior direction, and/or (ii) an axial force applied to the distal end of the structural component at least partially in the direction of the cushioning component causes the structural component (and cushioning component) to move (e.g., pivot or flex) in the anterior direction, can be used for a variety of purposes known to those skilled in the art.

Thus, reference to a "toothbrush" or "toothbrush assembly" should not be construed as being limited only to applications involving oral cleaning devices.

It is further to be understood that some of the drawings included herewith, and which are referenced herein, are diagrammatic, schematic, and other representations of example embodiments, and are not limiting on the present disclosure. Moreover, while various drawings are provided at a scale that is considered functional for some embodiments, the drawings are not necessarily drawn to scale for all contemplated embodiments. No inference should therefore be drawn from the drawings as to the necessity of any scale. Rather, the proportionality, scale, size, shape, form, function, and/or other feature of the disclosed embodiments can be altered without necessarily departing from the scope of this disclosure (unless such feature is expressly described herein as essential).

Furthermore, as indicated above, in the exemplary embodiments illustrated in the figures, like structures will be provided with similar reference designations, where possible. Specific language will be used herein to describe the exemplary embodiments. Nevertheless it will be understood that no limitation of the scope of the disclosure is thereby intended. Rather, it is to be understood that the language used to describe the exemplary embodiments is illustrative only and is not to be construed as limiting the scope of the disclosure (unless such language is expressly described herein as essential).

Alterations and further modifications of the inventive features illustrated herein, and additional applications of the principles illustrated herein, which would occur to one skilled in the relevant art and having possession of this disclosure, are to be considered within the scope of this disclosure. Unless a feature is described as requiring another feature in combination therewith, any feature herein may be combined with another feature of a same or different embodiment disclosed herein. Furthermore, various well-known aspects of illustrative systems, methods, apparatus, and the like are not described herein in particular detail in order to avoid obscuring aspects of the example embodiments.

Exemplary embodiments of the present disclosure generally relate to toothbrushes. In particular, the present disclosure relates to toddler toothbrushes and methods of forming the same. The present disclosure further relates to a safety toothbrush configured to flex in an anterior direction in response to axial pressure applied on or to the head. The toothbrush can also resist flexion in a posterior direction. For instance, the toothbrush can have an inner structural component and an outer cushioning component disposed about at least a portion of the structural component such that (i) the cushioning component inhibits flexion of the structural component in a posterior direction to a larger degree than the cushioning component inhibits flexion of the structural component in an anterior direction, and/or (ii) an axial force applied to the distal end of the structural component at least partially in the direction of the cushioning component causes the toothbrush to flex in the anterior direction. In certain embodiments, toothbrush flexion can be the result of the structural component moving (e.g., pivoting and/or flexing) forward, in the anterior direction. The cushioning component can also flex forward in some embodiments.

Reference will now be made to the figures to describe various aspects of example embodiments of the disclosure. FIG. 1A depicts a toothbrush assembly 10 incorporating some of the features of the present disclosure. For instance, toothbrush assembly 10 comprises a structural component 20, a cushioning component 60, and an optional cleaning element 40. As depicted in FIG. 1A, cleaning element 40 is attached to structural component 20 at a distal end 14 of toothbrush assembly 10. Cushioning component 60, on the other hand, is attached to structural component 20 and is generally disposed at proximal end 12 of toothbrush assembly 10.

Figure 1B:
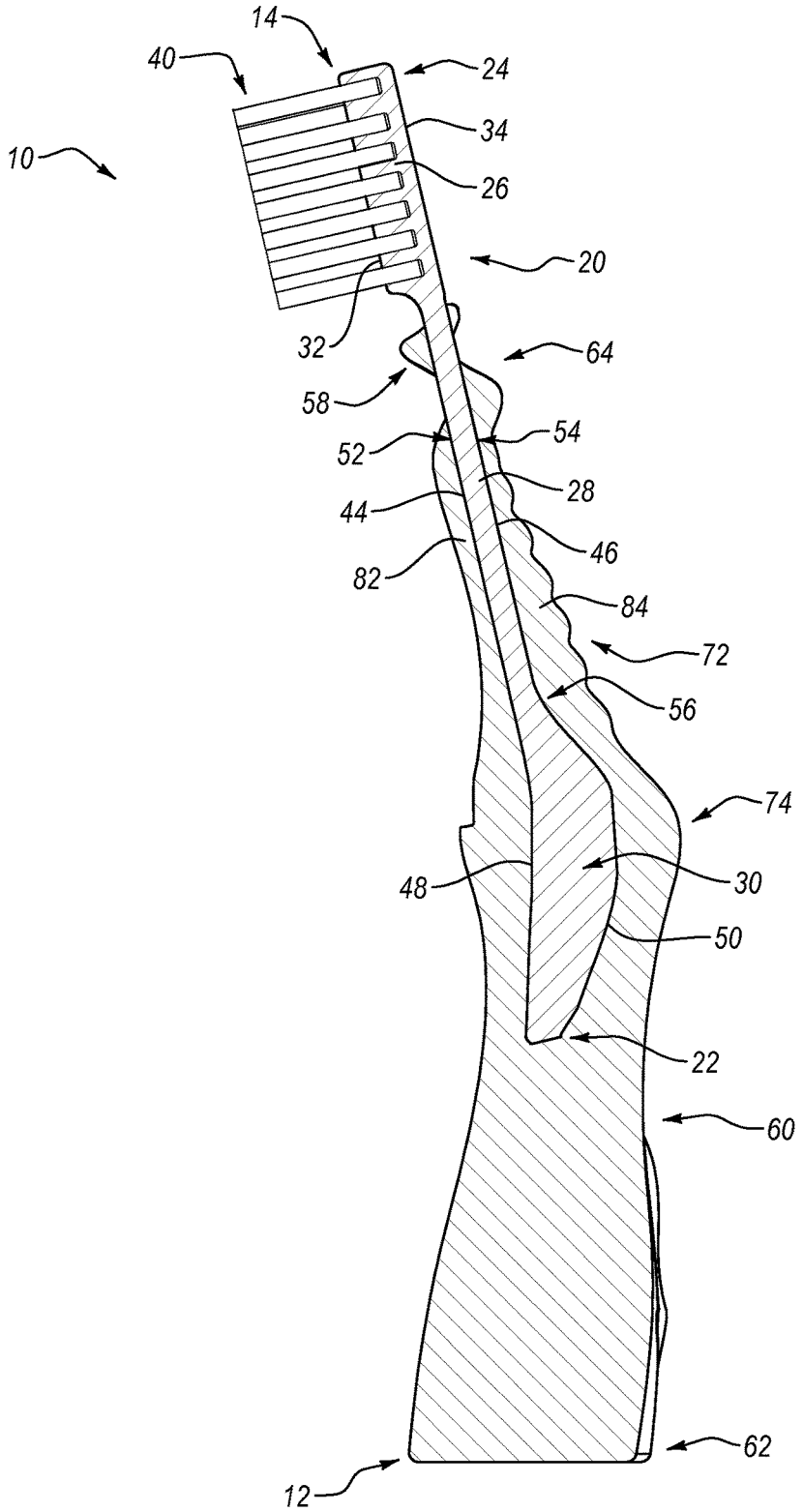
FIG. 1B illustrates a cross-sectional side view of the toothbrush assembly of FIG. 1A.

As depicted in FIG. 1B, a portion of structural component 20 is disposed inside cushioning component 60. Accordingly, a portion of cushioning component 60 is disposed about and/or around structural component 20. Structural component 20 comprises a head element 26, an elongated spacing element 28 extending from head element 26, and a body portion 30 connected to spacing element 28 opposite head element 26 such that spacing element 28 is disposed between head element 26 and a body portion 30. Accordingly, body portion 30 can be disposed at or near a proximal end 22 of structural component 20 and head element 26 can be disposed at or near a distal end 24 of structural component 20. Head element 26 is also disposed at or near distal end 14 of toothbrush assembly 10. Accordingly, distal end 24 of structural component 20 can form the distal end 14 of toothbrush assembly 10 and/or distal end 14 of toothbrush assembly 10 is comprised of distal end 24 of structural component 20.

Head element 26 of structural component 20 has an anterior side 32 and an opposing posterior side 34. In at least one embodiment, and as depicted in FIG. 1B, cleaning element 40 is attached to and/or extends from anterior side 32 of head element 26. In some embodiments, posterior side 34 of head element 26 can also have a cleaning element 40 attached thereto. Spacing element 28 of structural component 20 also has an anterior side 44 and an opposing posterior side 46. Body portion 30 of structural element 20 also has an anterior side 48 and an opposing posterior side 50. Accordingly, anterior sides 32, 44, and 48 can collectively form an anterior side 52 of structural component 20. Similarly, posterior sides 34, 46, and 50 can collectively form a posterior side 54 of structural component 20. In one or more embodiments, anterior side 52 and/or posterior side 54 can comprise and/or be formed of additional and/or other components.

Anterior side 48 of body portion 30 can have an at least partially concave shape and/or configuration in certain embodiments. In addition, posterior side 50 of body portion 30 can have an at least partially convex shape and/or configuration in certain embodiments. Furthermore, posterior side 50 of body portion 30 may extend further in the posterior direction from posterior side 46 of spacing element 28 than anterior side 48 extends in the anterior direction from anterior side 44 of spacing element 28. Accordingly, body element 30 can be more massive in the posterior direction than in the anterior direction.

Figure 1C:
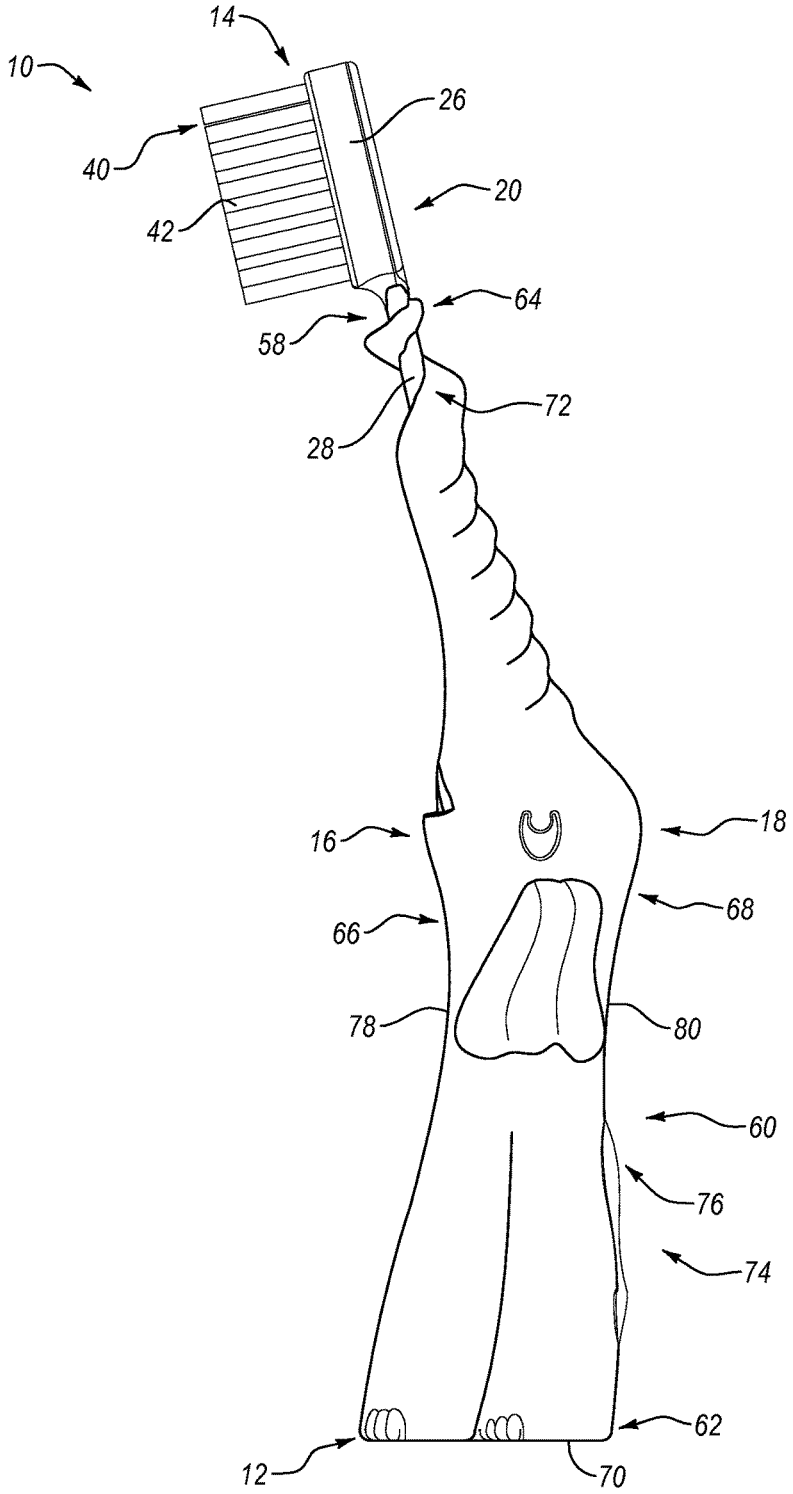
FIG. 1C illustrates a side view of the toothbrush assembly of FIG. 1A.

As illustrated in FIGS. 1B-1C, cushioning component 60 of toothbrush assembly 10 also has a proximal end 62 adjacent to and/or aligned with proximal end 12 of toothbrush assembly 10, and a distal end 64 opposite proximal end 62. A portion of distal end 64 can be attached to a portion of structural component 20. In particular, cushioning component 60 includes a distal portion 72 attached to spacing element 28 of structural component 20. For instance, at least a portion of spacing element 28 can be disposed entirely within a portion of cushioning component 60. Specially, a proximal end 56 of spacing element 28 can be disposed entirely within distal portion 72 of cushioning component 60. In at least one embodiment, a distal end 58 of spacing element 28 can be wrapped in distal portion 72 of cushioning component 60. Thus, distal portion 72 of cushioning component 60 can be wrapped around distal end 58 of spacing element 28.

With continued reference to FIGS. 1B-1C, a portion of cushioning component 60 can also be attached to body portion 30 of structural component 20. In at least one embodiment, a proximal portion 74 of cushioning component 60 can be disposed entirely about body portion 30 of structural component 20 such that body portion 30 is disposed entirely within a portion of cushioning component 60. Proximal portion 74 of cushioning component 60 can also include a handle portion 76. Handle portion 76 has an anterior side 78 and a posterior side 80. In at least one embodiment, anterior side 78 and/or posterior side 80 can have a concave configuration. Accordingly, handle portion 76 can have a generally double-concave (or hourglass) configuration. Cushioning component 60 similarly has an anterior side 66 and a posterior side 68.

Anterior side 16 of toothbrush assembly 10 can have an at least partially concave shape and/or configuration in some embodiments. Posterior side 18 of toothbrush assembly 10, on the other hand, can have an at least partially convex shape and/or configuration in some embodiments. As described in further detail below, the concave shape and/or configuration of anterior side 16 and corresponding convex shape and/or configuration of posterior side 18 can bias toothbrush assembly 10 to flex in an anterior direction (such that the shape and/or configuration of anterior side 16 becomes more concave and the shape and/or configuration of posterior side 18 becomes more convex). In addition, an axial force applied to head element 28 of structural component 20 in the direction of spacing element 28 can cause structural component 20 and/or spacing element 28 thereof to move in the anterior direction (e.g., such that head element 26 moves in the direction of anterior side 32). Accordingly, such an axial force can shorten the radius of curvature of toothbrush assembly 10 (such that the shape and/or configuration of anterior side 16 becomes more concave and the shape and/or configuration of posterior side 18 becomes more convex).

Furthermore, cushioning element 60 can include an anterior portion 82 (e.g., disposed on anterior side 52 of structural component 20 or spacing element 28 thereof) and a posterior portion 84 (e.g., disposed on posterior side 54 of structural component 20 or spacing element 28 thereof). In one or more embodiments, anterior portion 82 can be thicker than posterior portion 84. Specifically, a greater amount of cushioning element 60 can be disposed on posterior side 54 of structural component 20 and/or spacing element 28 thereof than on anterior side 52 of structural component 20 and/or spacing element 28 thereof. Accordingly, structural component 20 and/or spacing element 28 may move in the anterior direction (e.g., such that head element 26 moves in the direction of anterior side 32) with greater ease than structural component 20 and/or spacing element 28 moves in the posterior direction (e.g., such that head element 26 moves in the direction of posterior side 34). It will be appreciated that "radius of curvature" as used herein does not necessarily imply or require a circular and/or uniform curve shape.

In at least one embodiment, structural component 20 can be comprised and/or formed of or from a hard plastic material. Cushioning component 60, on the other hand, can be comprised and/or formed of or from a soft plastic material, in certain embodiments. Accordingly, cushioning component 60 may flex, bend, compress, contract, and/or otherwise deform with less force or effort than structural component 20. In addition, attachment of cushioning component 62 or about structural component 20 can increase the force required to flex, bend, compress, contract, and/or otherwise deform toothbrush assembly 10 and/or structural component 20 thereof.

Proximal end 62 of cushioning component 60 can also include a base member 70. Base member 70 can comprise a substantially flat surface and/or can be configured such that toothbrush assembly 10 can stand erect, independently, on base member 70. Opposite base member 70, head element 26 of structural component 20 (disposed at or near distal end 14 of toothbrush assembly 10) can have one or more cleaning elements 40 attached thereto and/or extending therefrom. As illustrated in FIG. 1C, cleaning element 40 can comprise a plurality of bristles 42. In alternative embodiments, however, cleaning element 40 can comprise one or more scrubbing, massaging, scraping, or other cleaning members.

Figure 1D:
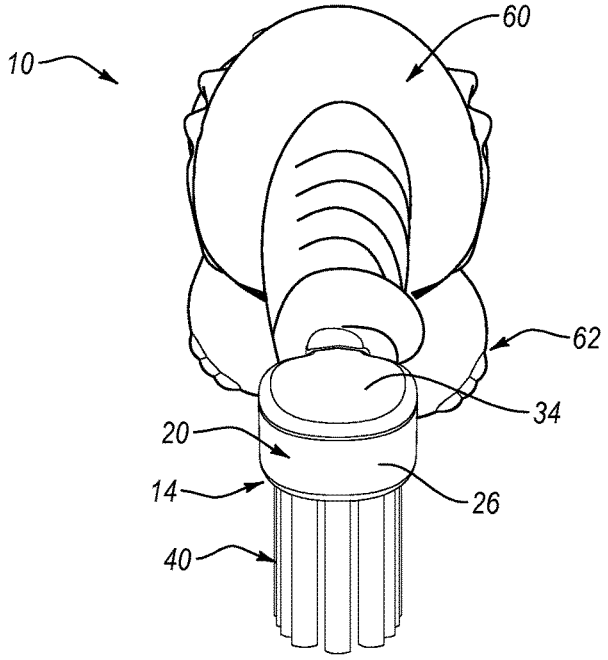
FIG. 1D illustrates a distal end view of the toothbrush assembly of FIG. 1A.
Figure 1E:
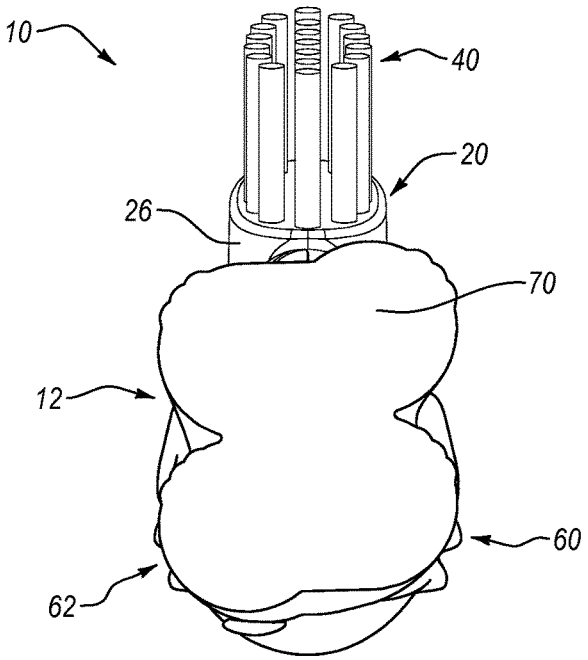
FIG. 1E illustrates a proximal end view of the toothbrush assembly of FIG. 1A.

FIGS. 1D and 1E illustrate a distal end view and a proximal end, respectively, of toothbrush assembly 10. Accordingly, FIG. 1D illustrates toothbrush assembly 10 from a vantage point originating at distal end 14 and FIG. 1E illustrates toothbrush assembly 10 from a vantage point originating at proximal end 12. As indicated above, toothbrush assembly 10 can have an anterior curved configuration. Accordingly, as illustrated in FIG. 1D, head element 26 of structural component 20 can be disposed anteriorly relative to a portion of cushioning component 60. Such an anterior curved configuration can bias toothbrush assembly 10 to flex (further) in the anterior direction.

As described above, base member 70 at proximal end 62 of cushioning component 60 can have a substantially flat surface and/or configuration. The substantially flat surface and/or configuration of base member 70 can allow toothbrush assembly 10 to stand erect, independently, on a structural surface (e.g., on a bathroom countertop).

Figure 2A:
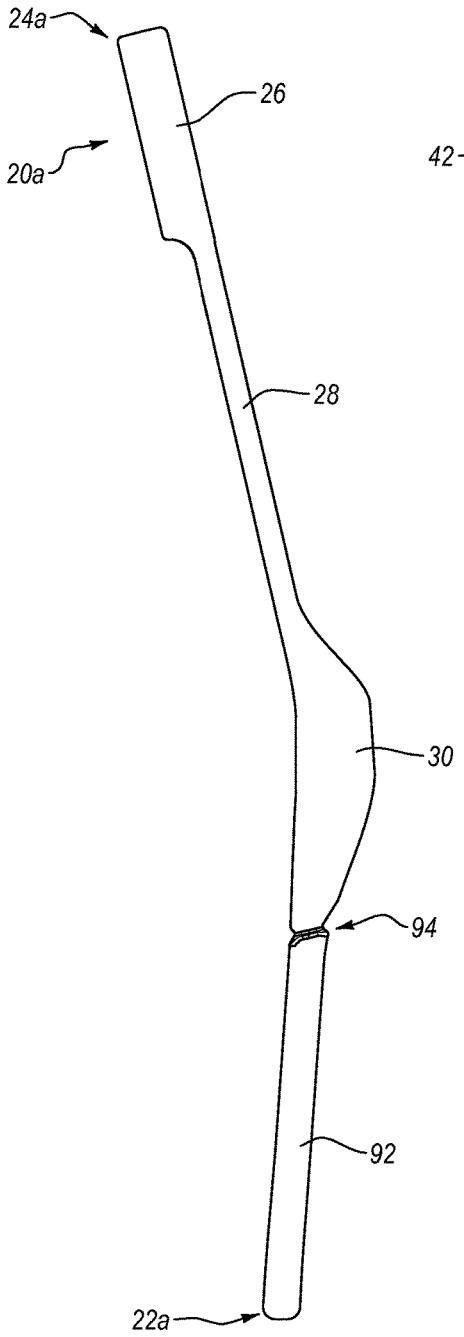
FIG. 2A illustrates a side view of a toothbrush structural component in a full-length configuration.

FIGS. 2A-2B and 3A-3C illustrate the formation of structural component 20 from an elongated structural component 20*a*. As illustrated in FIG. 2A, elongated structural component 20*a* can comprise the head element 26, spacing element 28, and body portion 30 of structural component 20. However, elongated structural component 20*a* also includes a tail element 92 attached to and/or extending proximally from body portion 30 in the axial direction. Accordingly, head element 26 is disposed at and/or adjacent to a distal end 24*a* of elongated structural component 20*a* and tail element 92 is disposed at and/or adjacent to a proximal end 22*a* of elongated structural component 20*a*. Furthermore, elongated structural component 20*a* can also include a separation element 94 disposed between body portion 30 and tail element 92. Separation element 94 can allow easy separation of tail element 92 from body portion 30. For instance, separation element 94 can comprise a thinning portion, perforation, or other structural formation configured to permit bending and/or breaking of the (hard plastic) material of structural component 20 (to remove tail element 92).

Figure 2B:
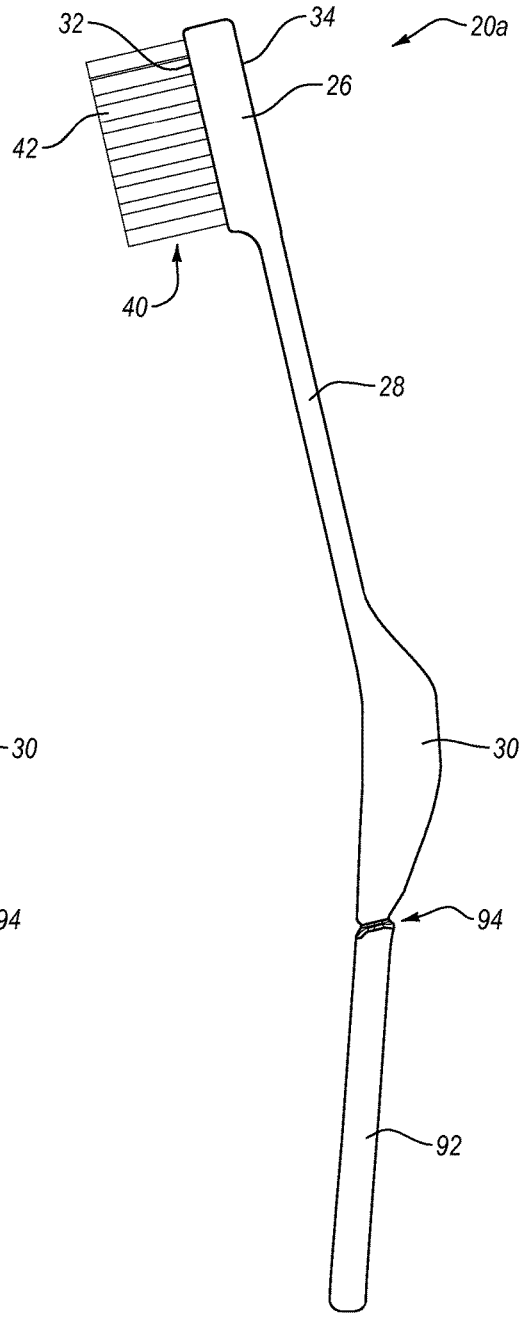
FIG. 2B illustrates the toothbrush structural component of FIG. 2A with a plurality of bristles attached thereto.

In at least one embodiment, tail element 92 can provide an additional length to elongated structural component 20*a*. Accordingly, structural component 20*a* can be better suited for insertion into and/or use with a cleaning elements applicator (e.g., bristle machine (not shown)). As illustrated in FIGS. 2A and 2B, cleaning element 40 and/or bristles 42 thereof can be applied and/or attached to head element 26 such that cleaning element 40 and/or bristles 42 thereof extend from head element 26 and/or anterior side 32 thereof (in the anterior direction). In some embodiments, the hard plastic composition of elongated structural component 20*a* and/or structural component 20 can enhance and/or simplified the attachment of cleaning element 40 and/or bristles 42 thereof.

Figure 3A:
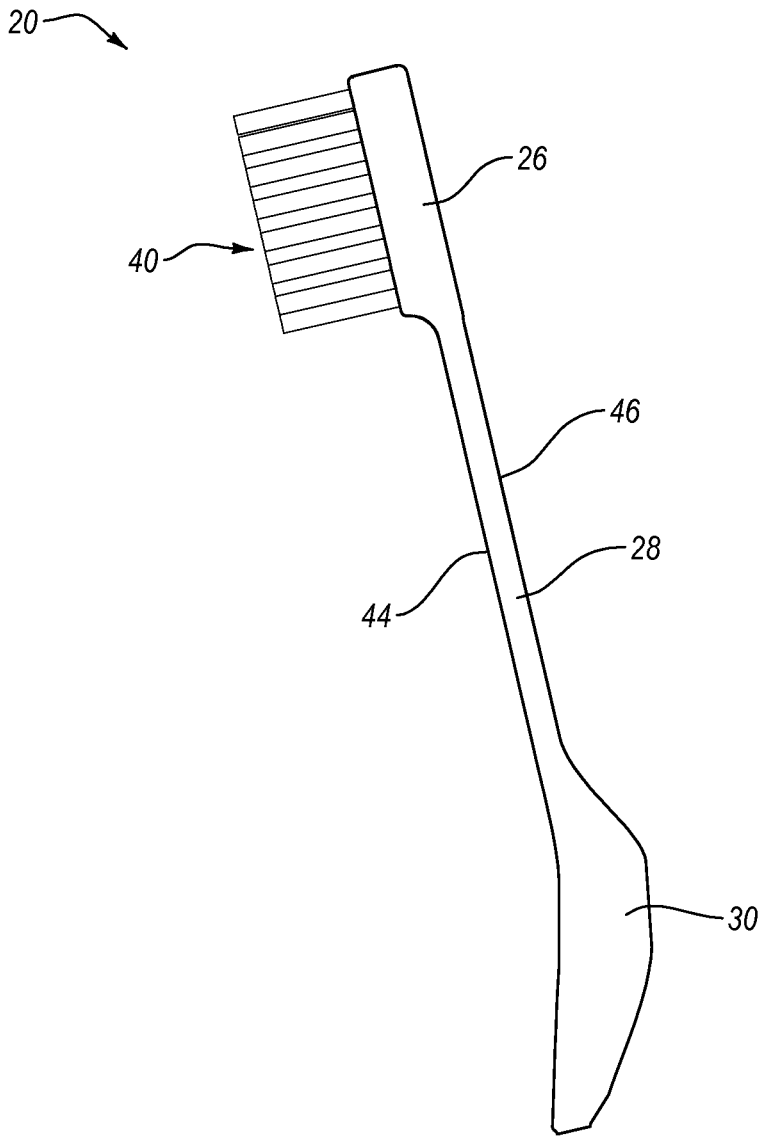
FIG. 3A illustrates the toothbrush structural component of FIG. 2B in a reduced-length configuration.

Tail element 92 can be removed from elongated structural component 20*a* (following attachment of cleaning element 40, in at least one embodiment) to form structural component 20, as illustrated in FIG. 3A. In certain embodiments, toothbrush assembly 10 can be more effective when tail element 92 is removed from body portion 30. In particular, toothbrush assembly 10 can have better flexion in the anterior direction if tail element 92 is removed from body portion 30.

In addition, with tail element 92 removed, structural component 20 and/or body element 30 thereof can be inserted into a mold (not shown). The mold can be configured and/or shaped such that a soft plastic (e.g., thermoplastic elastomer) material can be applied thereto and/or injected therein so as to form a cushioning component 60. Cushioning component 60 can thereby be bonded to structural component 20. In at least one embodiment, and as illustrated more fully in FIGS. 3B and 3C, body portion 30 can comprise a (hard plastic) mass disposed at the proximal end 56 of spacing element 28. The mass of body portion 30 can provide an internal structural member about which cushioning component 60 can be attached and/or to which cushioning component 60 can be bonded. For instance, by disposing and/or molding cushioning component 60 (entirely) about and/or around body portion 30, cushioning component 60 can be attached to structural element 20 such that cushioning component 60 is substantially, permanently attached and/or bonded to structural element 20 and/or body portion 30 thereof.

In at least one embodiment, the hard plastic core design and/or configuration of structural element 20 (e.g., body portion 30, spacing element 28, and/or head element 26) can maintain structural integrity during high-temperature overmolding (of cushioning component 60), while maintaining flexibility after the overmolding is complete. The combination of hard and soft plastic materials (of structural element 20 and cushioning component 60, respectively) can also be configured in such a way that the neck of the toothbrush (e.g., spacing element 28 and/or the portion of cushioning component 60 disposed thereabout) remains flexible while being protected from or against permanent deformation (e.g., being bent out of shape).

Figure 3B:
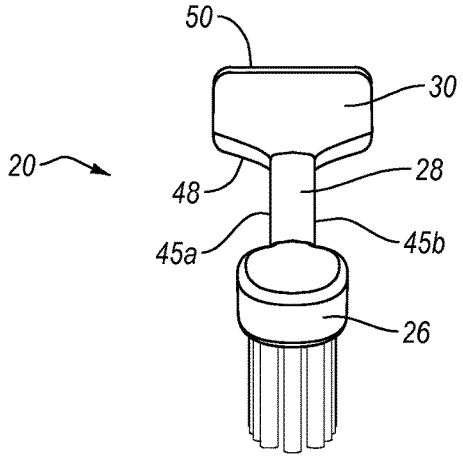
FIG. 3B illustrates a distal end view of the toothbrush structural component of FIG. 3A.
Figure 3C:
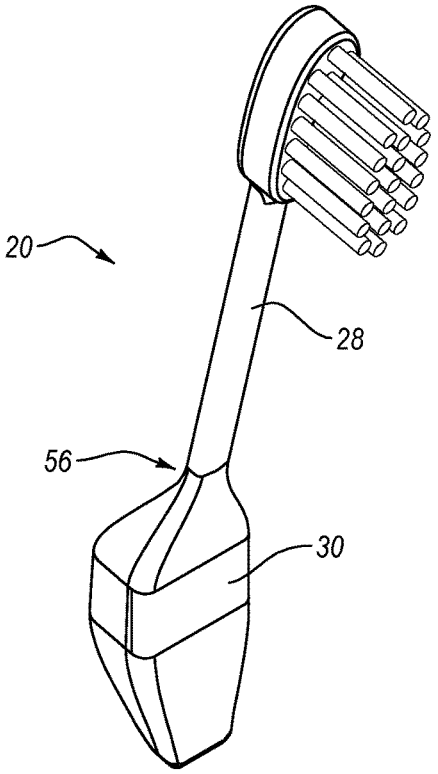
FIG. 3C illustrates a perspective view of the toothbrush structural component of FIG. 3A.

FIGS. 3A-3C also illustrates that spacing element 28 is wider (see FIG. 3B) than it is taller (see FIG. 3A). For instance, the distance between anterior side 44 and posterior side 46 of spacing element 28 (see FIG. 3A) can be shorter than the distance between lateral side 45*a* and the lateral side 45*b* of spacing element 28. Accordingly, structural component 20 and/or spacing elements 28 thereof may be configured to pivot, flex, bend, compress, contract, deform, and/or otherwise move in an anterior and/or posterior direction (more than in a lateral direction). Application of cushioning element 62 to structural component 20 and/or spacing element 28 thereof can further reduce and/or inhibit flexion, bending, compression, contraction, and/or other deformation of structural component 20 and/or spacing element 28 thereof.

Accordingly, an illustrative method of forming toothbrush assembly 10 can include providing elongated structural component 20*a* comprising distal head element 26, proximal tail element 92 opposite the head element 26, elongated spacing element 28 extending from head element 26, and body portion 30 connected to spacing element 28 opposite head element 26 such that body portion 30 is disposed between spacing element 28 and the tail element 92. The method can also include attaching a plurality of bristles 42 to head element 26 by means of a bristle machine, removing at least a portion of the tail element 92 from elongated structural component 20*a* so as to form structural component 20, and bonding a cushioning component 60 about body portion 30 and spacing element 28 such that cushioning component 60 resists movement of spacing element 28 in the posterior direction to a larger degree than cushioning component 60 resists movement of spacing element 28 in the anterior direction. Furthermore, an axial force applied to head element 26 at least partially in the direction of spacing element 28 causes spacing element 28 to move in the anterior direction.

An alternative method of forming toothbrush assembly 10 can include providing a structural component comprising a distal head element, an elongated spacing element extending from the head element, and a body portion connected to the spacing element opposite the head element, and securing a cushioning component about a portion of the structural component such that the cushioning component resists movement of the structural component in a posterior direction to a larger degree than the cushioning component resists movement of the structural component in an anterior direction.

In at least one embodiment, securing the cushioning component about a portion of the structural component can comprise bonding the cushioning component about the body portion and/or at least a portion of the spacing element (e.g., such that more of the cushioning component is disposed on a posterior side of the spacing element than on an anterior side of the spacing element thereof). A portion of the bonded cushioning component can extend from the body portion opposite the head element (e.g., forming a handle).

In some embodiments, the structural component further comprises a proximal tail element opposite the head element, the body portion being disposed between the spacer element and the tail element, and the method further comprises removing at least a portion of the tail element (e.g., before/prior to securing/bonding the cushioning component about a portion of the structural component).

The method can further comprise attaching one or more cleaning elements to the head element of the structural component. The one or more cleaning elements can be attached to the head element prior to removing at least a portion of the tail element. In addition, attaching the one or more cleaning elements to the head element of the structural component can comprise inserting the head element into a bristle machine, the one or more cleaning elements comprising a plurality of bristles. Accordingly, bonding the cushioning component about a portion of the structural component can comprise inserting the body portion and at least a portion of the spacing element into a mold, filling at least a portion of the mold with cushioning material, and allowing the cushioning material to bond to the body portion and at least a portion of the spacing element.

As indicated above, the structural component can be more rigid than the cushioning component. Accordingly, when the toothbrush assembly is formed, it can comprise a structural component comprising a distal head element, an elongated spacing element extending from the head element, and a body portion connected to the spacing element opposite the head element, and a cushioning component disposed about a portion of the structural component such that the cushioning component resists movement of the structural component in a posterior direction to a larger degree than the cushioning component resists movement of the structural component in an anterior direction. In addition, the structural component can be more rigid than the cushioning component.

The cushioning component can be secured to the body portion and at least a portion of the spacing element such that more of the cushioning component is disposed on a posterior side of the spacing element than on an anterior side of the spacing element. In addition, the cushioning component can be molded about and/or bonded to the body portion and the at least a portion of the spacing element and/or can have an at least partially concave anterior configuration. A proximal portion of the cushioning component can extend from the body portion opposite the head element to form a handle portion. The handle portion can be substantially thicker than the spacing element and/or can have an at least partially concave anterior surface and/or and at least partially concave posterior surface. Such a configuration encourages a toddler or other user of the toothbrush assembly to properly grip the toothbrush assembly in a distal, oblique grip, as may be recommended by a dentist.

As indicated above, the structural component can be less flexible than the cushioning component. For instance, the structural component can comprise a thermoplastic polymer and the cushioning component can comprise a thermoplastic elastomer. Importantly, an axial force applied to the head element at least partially in the direction of the spacing element can cause the spacing element to flex in the anterior direction. Accordingly, should the toddler or other user accidentally and/or inadvertently jam the toothbrush assembly deep into the oral cavity, the toothbrush assembly can flex in the anterior direction such that the toothbrush assembly and/or one or more components thereof can be less likely to impale the user's throat tissue and/or puncture a vital artery.

Toothbrush assembly can also include one or more cleaning elements attached to the head element of the structural component. The one or more cleaning elements can comprise bristles (extending from the anterior side of the head element of the structural component).

It will be noted and/or appreciated by those skilled in the art, in light of the disclosure herein, that the combination of hard plastic and soft plastic can have a number of advantages relative to prior, known, and/or existing toothbrushes. For instance, with a soft plastic cushioning component disposed about the spacing element of the structural component, the toothbrush assembly and/or structural component thereof and/or spacing element thereof can bend forward, in the anterior direction, easier and/or with less force than it can bend in the posterior direction. Specifically, in response to axial pressure applied at the distal end of the head element (in the direction of the proximal end of the toothbrush assembly) at least a portion of the toothbrush assembly can flex in the anterior direction. Such flexion can provide additional safety to toddlers learning to brush their teeth and/or other users.

It will also be appreciated, however, that the toothbrush assembly can provide a proper amount of resistance against flexion in the posterior direction. Accordingly, the toothbrush assembly can still function as an oral cleaning device as required and/or desirable to users and those skilled in the art. For instance, the head can also flex in the posterior direction to prevent excess force (e.g., pressure) from being applied to teeth during brushing. However, the anterior curvature of the toothbrush assembly can bias the toothbrush assembly for anterior flexion and/or against posterior flexion when axial force is applied to the head. In addition, with more cushioning material of the cushioning component disposed on the posterior side of the structural component and or spacing element thereof, the cushioning component can also resist and/or inhibit flexion in the posterior direction while permitting and/or to a greater degree than resisting and/or inhibiting flexion in the anterior direction.

Lateral flexion can also be additionally resisted and/or inhibited by the application of the cushioning component. The thicker lateral structure of the structural component and/or spacing element thereof (relative to the height of the structural component and/or spacing element thereof) can provide additional resistance and/or inhibition against lateral flexion relative to anterior and/or posterior flexion. Resistance against twisting and/or lateral flexion can also be important to and/or required by users and/or those skilled in the art. In addition, resisting twisting and/or lateral flexion can also enhance the safety of using the toothbrush assembly.

The hard plastic composition of the structural component allows for the application and/or attachment of one or more cleaning elements thereto. For instance, traditional toothbrush bristles can be easily attached to the head element by using a bristle applicator machine. The longer, extended tail of the elongated structural component enhances the ease of using such a bristle machine. For instance, certain conventional bristle machines may require the additional length provided by the tail element. Those skilled in the art will also appreciate that application of the cushioning component prior to application of the cleaning element (or plurality of bristles thereof) may prevent consistent application and/or attachment of the cleaning element(s). In addition, attachment of the cushioning component prior to removal of the tail element can alter the flexion properties of the toothbrush assembly. Accordingly, in certain embodiments, the bristles are applied to the elongated structural component prior to removal of the tail element, and the cushioning component is bonded to the structural component after removal of the tail element. Additional cleaning elements can also be attached (for instance, to the posterior side of the head element) before and/or after attachment of the cushioning component.

The soft plastic cushioning component can be molded over portion(s) of the underlying structural component. Accordingly, the structural component and/or one or more elements and/or portions thereof, can serve as an underlying structural frame for the finished toothbrush assembly. Contrary to traditional and/or existing toothbrushes, which usually only provide soft gripping features on a portion of the hard plastic handle, embodiments of the present disclosure can include a soft plastic overmold disposed (entirely) about a portion of the hard plastic structural element. For instance, as indicated above, the cushioning element can be bonded entirely about the body portion of the structural element.

The larger mass of the body portion of the hard plastic structural element can be more ideal for soft plastic over molding than long, thin, elongated hard plastic structural elements. For instance, the large mass of hard plastic can provide a base to which the soft plastic cushioning material can become bonded. In addition, the hard plastic body portion may be easier for an over mold machine to receive and/or retain. Furthermore, the hard plastic material may not melt or become deformed upon application of heated, soft plastic material used in the formation of the cushioning component. In one or more alternative embodiments, however, the tail portion may not be snipped off prior to an application of cushioning material. For instance, a first application of cushioning material may occur with the tail element still attached to the structural component and/or body portion thereof.

As indicated above, the toothbrush assembly, and/or one or more components thereof (such as the structural component and or cushioning component) can have an overall curvature in the anterior direction (e.g., so as to form a "C-shape"). This bend or curve in the toothbrush assembly can bias the toothbrush assembly to flex (further) in the anterior direction. In addition, soft plastic (thermoplastic elastomer) material can stretch and/or elongate under less force (i.e., easier) than it compresses and/or flexes. In addition, because the soft plastic cushioning component can be bonded to the hard plastic structural component with the anterior curvature, the concave, anterior portion of the cushioning component on the anterior side of the toothbrush assembly can be more resistant to compression than the convex, posterior portion of the cushioning component on the posterior side of the toothbrush assembly. Accordingly, as indicated above, the cushioning component can be applied and/or attached such that more of the cushioning component is disposed on the posterior side of the toothbrush assembly and/or the structural component thereof than on the anterior side. By so doing, the cushioning material can provide added resistance to flexion in the posterior direction than in the anterior direction.

Resistance against flexion in the posterior direction can be an important feature of the toothbrush assembly. For instance, even toddler toothbrushes need to resist and/or inhibit flexion in the posterior direction to a degree so that toddler's teeth can be effectively cleaned during brushing. In addition, it may not be desirable for a toothbrush assembly to bend, twist, and/or otherwise move in an at least a partially lateral (side-to-side) direction. For instance, users may find such bending and or twisting undesirable during brushing.

However, in at least one embodiment, rigidity (resistance and/or inhibition of flexing) in the forward, anterior direction may also be undesirable. For instance, certain embodiments of the present disclosure include a toothbrush assembly that flexes in the anterior direction in response to axial pressure applied to the distal end of the toothbrush assembly head element. Accordingly, a toddler or other user who accidentally and/or inadvertently forces the toothbrush against a portion of the oral cavity and/or throat, may not be impaled by the head element because of the tendency of the toothbrush assembly to flex in the anterior direction.

Contrary to embodiments of the present disclosure, a variety of existing toothbrushes require anterior resistance and/or inhibition to flexing in the anterior direction. For instance, some toothbrushes include a posteriorly attached tongue scrubber, opposite the teeth cleaning bristles. Resistance and/or inhibition of flexing in the anterior direction may be required and/or desirable in order to facilitate proper use of such tongue scrubbers.

The cushioning component also has a wide base element in some embodiments. Accordingly, the toothbrush assembly can be designed and/or configured to stand freely, erect, and/or independently on a structural surface such as a bathroom countertop. In addition, the toothbrush assembly and/or handle portion thereof can be sized specifically for grip by a toddler's hands. For instance, handle portion can be shorter than adult toothbrush handles. However, in at least one embodiment, the handle portion can have a significant thickness. In addition, the handle portion can have an at least partially concave surface configuration. In at least one embodiment, the handle portion can have a double-concave surface configuration, at least partially resembling an hourglass. Accordingly, a toddler gripping the handle portion may instinctively grab the toothbrush assembly with a distal oblique grip, as can be preferred and/or recommended by certain dentists. The cushioning portion may also be easier for a toddler to grip and/or hang onto. Accordingly, the soft, cushioning material (overmold) can have both structural and flexible elements.

Accordingly, various embodiments of the present disclosure overcome or solve one or more of the foregoing or other problems in the art, by providing a toothbrush assembly configured to flex forward, in the anterior direction, in response to an axial pressure applied to the distal end of the toothbrush assembly. The overall anterior curvature of the underlying structural component and/or one or more elements or portions thereof, overall anterior curvature and/or bifurcated anterior-posterior thickness of the cushioning component disposed about at least a portion of the structural component, and/or other feature is described herein may resist and/or inhibit (or cause the toothbrush assembly to resist and/or inhibit) flexion in the posterior direction, while allowing flexion in the anterior direction. In addition, the toothbrush assembly and/or one or more components thereof can be configured so as to be biased in the anterior direction. Thus, the cushioning component can resist flexion of the structural component in the posterior direction to a larger degree than the cushioning component resists flexion of the structural component in an anterior direction in certain embodiments.

The foregoing detailed description makes reference to specific exemplary embodiments. However, it will be appreciated that various modifications and changes can be made without departing from the scope contemplated herein and as set forth in the appended claims. More specifically, while illustrative exemplary embodiments in this disclosure have been more particularly described, the present disclosure is not limited to these embodiments, but includes any and all embodiments having modifications, omissions, combinations (e.g., of aspects across various embodiments), adaptations and/or alterations as would be appreciated by those in the art based on the foregoing detailed description. The limitations in the claims are to be interpreted broadly based on the language employed in the claims and not limited to examples described in the foregoing detailed description, which examples are to be construed as non-exclusive.

Moreover, any steps recited in any method or process described herein and/or recited in the claims may be executed in any order and are not necessarily limited to the order presented in the claims, unless otherwise stated (explicitly or implicitly) in the claims. Accordingly, the scope of the invention should be determined solely by the appended claims and their legal equivalents, rather than by the descriptions and examples given above.

It will also be appreciated that various features, members, elements, parts, and/or portions of certain embodiments of the present invention are compatible with and/or can be combined with, included in, and/or incorporated into other embodiments of the present invention. Thus, disclosure of certain features, members, elements, parts, and/or portions relative to a specific embodiment of the present invention should not be construed as limiting application or inclusion of said features, members, elements, parts, and/or portions to the specific embodiment. Rather, it will be appreciated that other embodiments can also include said features, members, elements, parts, and/or portions without necessarily departing from the scope of the present invention. Likewise, certain embodiments can include fewer features than those disclosed in specific examples without necessarily departing from the scope of this disclosure.

In addition, the present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A toddler toothbrush assembly, comprising:

a structural component comprising a distal head element, an elongated spacing element extending from the head element, and a body portion connected to the spacing element opposite the head element; and a cushioning component disposed about a portion of the structural component such that the cushioning component resists movement of the structural component in a posterior direction relative to the cushioning component to a larger degree than the cushioning component resists movement of the structural component in an anterior direction relative to the cushioning component.

2. The toothbrush assembly of claim 1, wherein the cushioning component is secured to the body portion and at least a portion of the spacing element such that more of the cushioning component is disposed on a posterior side of the spacing element than on an anterior side of the spacing element.

3. The toothbrush assembly of claim 1, wherein the cushioning component comprises an at least partially concave anterior configuration.

4. The toothbrush assembly of claim 1, wherein the cushioning component is molded about and bonded to the body portion and at least a portion of the spacing element.

5. The toothbrush assembly of claim 1, wherein a proximal portion of the cushioning component extends from the body portion opposite the head element, the proximal portion comprising a handle portion.

6. The toothbrush assembly of claim 5, wherein the handle portion comprises an at least partially concave anterior surface and/or and at least partially concave posterior surface.

7. The toothbrush assembly of claim 1, wherein the structural component is less flexible than the cushioning component.

8. The toothbrush assembly of claim 7, wherein the structural component comprises a thermoplastic polymer and the cushioning component comprises a thermoplastic elastomer.

9. The toothbrush assembly of claim 1, wherein an axial force applied to the head element at least partially in the direction of the spacing element causes the spacing element to move in the anterior direction.

10. The toothbrush assembly of claim 1, further comprising one or more cleaning elements attached to the head element of the structural component.

11. The toothbrush assembly of claim 10, wherein the one or more cleaning elements comprises a plurality of bristles.

12. The toothbrush assembly of claim 1, having an at least partially concave configuration in the anterior direction.

* * * * *